US005088890A

United States Patent [19]

Jewess

[11] Patent Number: 5,088,890

[45] Date of Patent: Feb. 18, 1992

[54] SEAL CONSTRUCTION FOR USE IN A TURBINE ENGINE

[75] Inventor: Gordon Jewess, San Diego, Calif.

[73] Assignee: Sundstrand Corporation, Rockford, Ill.

[21] Appl. No.: 448,255

[22] Filed: Dec. 11, 1989

[51] Int. Cl.[5] ..... F01D 11/00

[52] U.S. Cl. ..... 415/112; 415/231; 277/85; 403/326; 384/475; 384/483

[58] Field of Search ..... 415/110, 111, 112, 229, 415/230, 231, 170.1, 216.1, 173.5, 174.5, 174.2; 277/DIG. 8, 22, 85, 81 R, 53, 65, 15; 384/475, 483, 477; 403/326

[56] References Cited

U.S. PATENT DOCUMENTS

| | | | |
|---|---|---|---|
| 2,688,520 | 9/1954 | Covington | 308/187.1 |
| 2,752,176 | 6/1956 | Ayling | 286/11 |
| 3,033,579 | 5/1962 | Seaver | 277/65 |
| 3,218,110 | 11/1965 | Conner | 277/81 |
| 4,334,720 | 6/1982 | Siener | 384/475 |
| 4,380,416 | 4/1983 | Menager | 415/170 |
| 4,605,235 | 8/1986 | Sundberg et al. | 277/87 |
| 4,795,169 | 1/1989 | Lowe et al. | 277/87 |
| 4,898,523 | 2/1990 | Harwath | 403/326 |
| 4,932,207 | 6/1990 | Harris et al. | 415/174.2 |

*Primary Examiner*—Edward K. Look
*Assistant Examiner*—Hoang Nguyen
*Attorney, Agent, or Firm*—Wood, Phillips, Mason, Recktenwald & VanSanten

[57] ABSTRACT

Leakage of compressed air into the lubrication system of a gas turbine engine is prevented by a seal construction including a housing (44), a hollow shaft (40) extending through the housing (44) and adapted to receive lubricant on its interior (58), and a bearing (48) journalling the shaft for rotation within the housing. The bearing (48) includes an inner race (60) provided with a sealing surface (72). A seal holder (74) is carried by the housing (44) and receives an annular seal (82). Passages (94), (96) through the hollow shaft (40) align with passages (98), (102) in the inner race (60) to one side of the sealing surface (72) to direct lubricant from the interior (58) of the hollow shaft (40) to the bearing (48).

9 Claims, 2 Drawing Sheets

SEAL CONSTRUCTION FOR USE IN A TURBINE ENGINE

FIELD OF THE INVENTION

This invention relates to seal constructions and, more particularly, to seal constructions employed with lubrication systems and which are particularly suited for use in a gas turbine engine.

BACKGROUND OF THE INVENTION

Not infrequently, gas turbine engines present some unusual sealing requirements. Like any other apparatus having relatively moving parts, provision must be made for lubricating the interfaces of the relatively moving parts. At the same time, by reason of the incorporation of rotary compressors in gas turbine engines, there also exists high pressure gas, typically air, during operation of the turbine engine. Depending upon rotor construction, there may be an opportunity for leakage of the gas under pressure from the compressor section of the engine to the areas of power takeoffs or the like, whereat bearings are located and to which lubricant must be directed. Obviously, gas under pressure, in some situations could interfere with, or even prevent the flow of lubricant against the leaking gas under pressure to areas requiring lubrication; and care must be taken in providing seals to prevent such an occurrence.

Further, the same paths of compressed gas leakage during engine operation can also provide paths for the leakage of lubricant when the engine is not in operation.

The present invention is directed to overcoming one or more of the above problems.

SUMMARY OF THE INVENTION

It is the principal object of the invention to provide a new and improved seal and lubrication construction. More specifically, it is an object of the invention to provide such a seal and lubrication construction that is ideally suited for use in a turbine engine.

An exemplary embodiment of the invention achieves the foregoing objects in a construction including a housing, a hollow shaft extending through the housing and adapted to receive lubricant in its interior, and a bearing journalling the shaft for rotation with the housing. The bearing includes an inner race mounted on the shaft, an outer race mounted within the housing and movable bearing elements located between the races. Aligned passages are located in the inner race and the shaft. A sealing surface is disposed at the inner race of the bearing and is axially spaced from the passages. A seal holder is carried by the housing in adjacency to the sealing surface while an annular seal is located in the seal holder and extends out of the same into engagement with the sealing surface. Means are provided for biasing the seal against the sealing surface.

As a consequence of this construction, an excellent seal at the bearing is obtained. The inner race of the bearing serves not only the usual function associated with bearing inner races, but also forms part of the seal.

In a preferred embodiment, the sealing surface is on an axially facing side of the inner race and the biasing means applies an axial bias to the seal.

In a highly preferred embodiment, the inner race includes an circumferentially continuous, radially outwardly extending flange and the sealing surface is on a side of the flange near the radially outer extremity thereof.

Preferably, there is an area of reduced axial thickness between the sealing surface and the remainder of the inner race.

The invention also contemplates the provision of an O-ring seal between the annular seal and the seal holder.

In a highly preferred embodiment, an interior support shaft is disposed within the hollow shaft and is generally spaced from the interior thereof. A baffle is carried by the interior shaft and sealingly engages the interior of the hollow shaft on one side of the passages. An additional passage through the hollow shaft is provided and is spaced from the previously mentioned passages to be on the other side of the baffle. An annular, labyrinth seal is located on the hollow shaft and extends into proximity of the housing and is located between the passages on the one hand, and the additional passage on the other.

The invention further contemplates that the hollow shaft include an outwardly opening groove and that a resilient C-clip be retained in the groove above the bottom thereof and extend partly out of the groove. One of the seals has a cam surface adapted to engage the C-clip and cam the same fully into the groove so that the seal may move axially past the C-clip to be retained on the hollow shaft thereby. After the seal passes the C-clip, its resiliency causes the same to partly emerge from the groove to retain the seal.

Other objects and advantages will become apparent from the following specification taken in connection with the accompanying drawings.

DESCRIPTION OF THE PREFERRED EMBODIMENT

Figure 1:
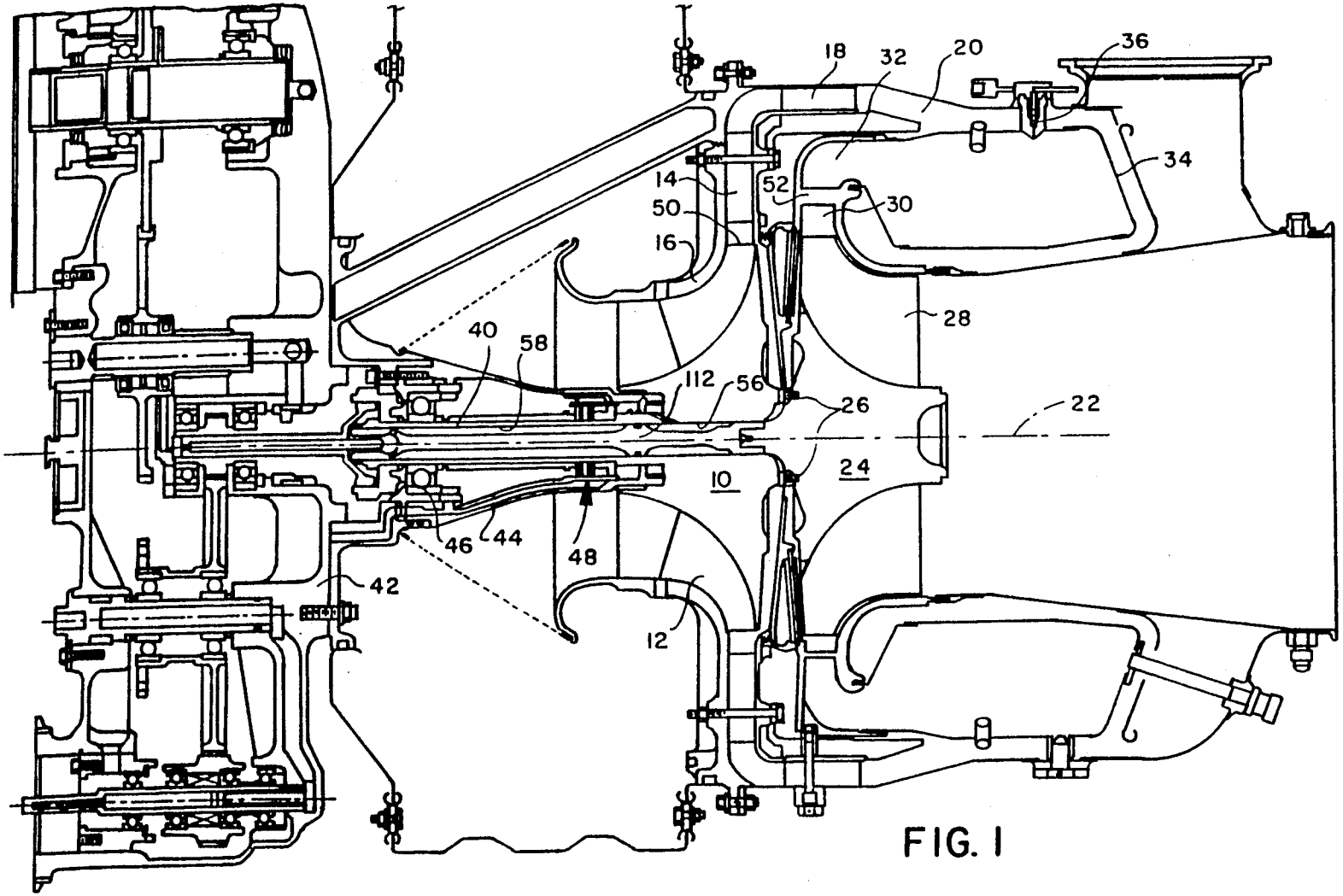
FIG. 1 is a sectional view of a gas turbine engine in which a seal and lubrication construction made according to the invention may be advantageously employed.

An exemplary embodiment of the invention is illustrated in FIG. 1 and will be described herein in the environment of a radial gas turbine. However, it should be understood that the invention may be advantageously employed in other environments as well, and that no restriction thereto is intended except insofar as stated in the appended claims.

With reference to FIG. 1, there is seen a gas turbine engine including a compressor hub 10 having compressor blades 12 which define a rotary compressor. Upon rotation of the hub 10, the blades 12 direct compressed air radially outward to a conventional diffuser 14 supported by a compressor shroud 16. The diffuser 14 converts the velocity head of the compressed gas to a static head and the gas is directed through deswirl vanes 18 to an annular plenum 20 disposed about the turbine rotational axis 22.

A turbine wheel hub 24 is fastened to the hub 10 as by threaded fasteners 26 and includes radial turbine blades 28. Radially outwardly of the blades 28 is an annular nozzle 30 connected to the outlet 32 of an annular combustor 34 located within the plenum 20. Combustion air from the compressor defined by the hub 10 and the blades 12 is directed to the interior of the combustor 34 by conventional means and is used to oxidize fuel injected by injectors 36 (only one of which is shown). The resulting hot gases of combustion then flow out of the outlet 32 and are directed by the nozzle 30 against the blades 28 to drive the turbine wheel hub 20 and thus the compressor 10.

In the embodiment illustrated, a hollow shaft 40 extends from the compressor hub 10 to a transmission 42. The shaft 40 serves as a power takeoff device whereby the energy developed by the engine may be utilized to drive hydraulic pumps, generators or the like. The transmission 42 includes a somewhat funnel-shaped housing 44 that is generally concentric to the shaft 40 which in turn is concentric to the rotational axis 22 of the turbine. At the enlarged end of the housing 44, ball bearings 46 are employed to journal the shaft 40, while adjacent the hub 10, a roller bearing construction, generally designated 48, is utilized.

Before proceeding further with the description, it should be understood that a leakage path for air from the compressor exists at the interface between the hubs 10 and 24. Note that immediately adjacent the radially outer edges 50 of the compressor blades 16 there is a small gap needed to provide clearance between the rotating compressor blades and hub 10 on the one hand, and stationary structure such as the diffuser 14 and components associated therewith as the front turbine shroud 52 on the other. This clearance allows the compressed air at the outlet of the compressor to enter the interface between the hubs 10 and 24 and, as a consequence, such high pressure air may enter an interior bore 56 within the hub 10 which typically is a continuation of the interior 58 of the hollow shaft 40.

Figure 2:
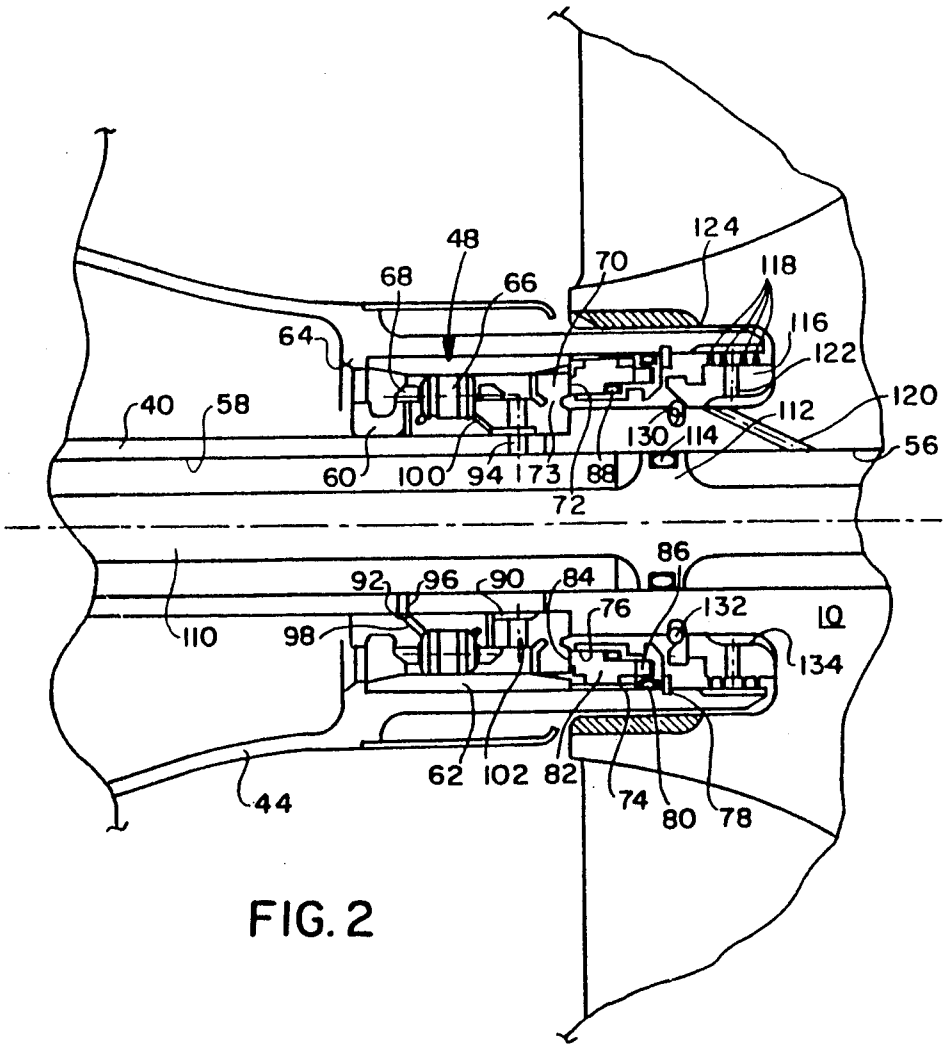
FIG. 2 is an enlarged, fragmentary sectional view of the seal and lubrication construction.

Turning now to FIG. 2, it will be seen that the roller bearing assembly 48 includes an inner race 60 mounted on the exterior surface of the hollow shaft 40, an outer race 62 retained against a flange 64 on the housing 44, as well as rollers 66, which may be retained by a cage 68.

On the end of the inner race 60 opposite the retaining flange 64 on the housing 44, the inner race 60 includes a circumferential, radially outwardly directed flange 70 which in turn has an axially facing sealing surface 72 near its radially outer periphery. The flange 70 also has, at a location radially inwardly of the sealing surface 72, a reduced axial thickness section 73.

An annular seal holder 74 having an interior seal receiving cavity 76 opening toward the sealing surface is abutted against a lock ring 78, so as to be sandwiched against the outer race 62 and firmly urge the same against the retaining flange 64. Adjacent the lock ring 78, an O-ring seal 80 may be interposed between the housing 44 and the seal holder 74.

A ring-like, annular, carbon face seal 82 is located within the cavity 76 and includes an axially facing sealing surface 84 facing and engaged with the sealing surface 72 on the inner race 60. A wavy spring 86 within the cavity 76 acts against the carbon face seal 82 to bias the same into sealing engagement with the surface 72.

An O-ring seal 88 may be located within the seal holder 74 to seal the interface between the seal 82 and the seal holder 74.

As viewed in FIG. 2, to the left of the flange 70, the inner race 60 has a pair of annular grooves 90 and 92 on its inner surface. The groove 90 is in alignment with a radial bore 94 in the shaft 40, while the groove 92 is in alignment with a radial bore 96, also in the shaft 40, but on the other side of the rollers 66. A series of diagonal passages, only one of which is shown, extend from the groove 92 to the left hand side of the rollers 66, while similar diagonal grooves 98 extend from the annular groove 90 to the right hand side of the rollers 66. In addition, radial bores 102 through the inner race 60 establish fluid communication between the annular groove 90 and the space between the races 60 and 64.

Lubricant may be flowed along the interior 58 of the hollow shaft 40 and will exit the same through the bores 94 and 96 to provide lubrication for the rollers 66 by the passages previously described. At the same time, such lubricant cannot pass further to the right as viewed in FIG. 2 by reason of the presence of the seal 82 sealing the interface of the housing 44 on the one hand, and the rotary components on the other.

In one embodiment of the invention, an interior, support shaft 110 is disposed within the hollow shaft 40 in spaced relation to the interior 58 thereof, so as to provide for lubricant passage. However, the shaft 110 also includes a baffle formation 112 which carries a seal 114 for sealing engagement with the interior 58 of the shaft 110. As can be seen in FIG. 1, the baffle formation 112 isolates lubrication flowing in the hollow shaft 40 on the left hand side of the baffle 112 from leaking compressed air on the right hand side of the baffle 112.

Desirably, a labyrinth seal ring 116 having labyrinth projections 118 in proximity to the housing 44 is located to the right of the seal holder 82. Diagonally extending grooves 120 from the interior 56 allow the leakage air to flow to the labyrinth seal 116 and pass through radial grooves 122 therein that open between the labyrinth projections 118, thus providing for controlled leakage of the compressed air both toward the seal holder 74 on the one hand, and through a space or clearance 124 between the hub 10 and the housing 44 on the other.

The hollow shaft 40 includes a radially outwardly opening groove 130 in which a resilient C-clip 132 is partially received. That is to say, the C-clip 132 does not bottom out within the groove 130 in its normal configuration, but extends partly out of it. However, the depth of the groove 130 is sufficient so that the C-clip 132 may be collapsed against its inherent resilience to fit entirely within the groove 30.

The right hand inner surface 134 of the labyrinth seal 116 is a cam surface. During installation, the surface 134 will engage the C-clip 132 previously placed within the groove 130 and cam the same fully into the groove 130. The labyrinth seal 116 may then be moved axially to the right until it passes over the C-clip 132. At that time, the latter will pop partially out of the groove 130 to the position illustrated to provide for retention of the labyrinth seal 116.

From the foregoing, it will be appreciated that a seal and lubrication construction made according to the invention provides an ideal means of preventing lubricant from leaking through compressed air passages, or compressed air from preventing proper lubrication. By employing the inner race 60 to serve the dual function of an inner race, as well as part of a seal, the construction is simplified, and thus made more reliable.

What is claimed is:

1. A turbine seal and lubrication construction comprising:

a housing;

a hollow shaft extending through said housing and adapted to receive lubricant in its interior;

a bearing journalling said shaft for rotation within said housing and including an inner race mounted on said shaft, an outer race mounted within said housing and movable bearing elements located between said races;

aligned passages in said inner race and said shaft;

a sealing surface on said inner race and axially spaced from said passages;

a seal holder carried by said housing in adjacency to said sealing surface;

an annular seal in said seal holder and extending out of the same into engagement with said sealing surface; and means biasing said seal against said sealing surface.

2. The turbine seal and lubrication construction of claim 1 wherein said sealing surface is on an axially facing side of said inner race and said biasing means applies an axial bias to said seal.

3. The turbine seal and lubrication construction of claim 2 wherein said inner race includes a circumferentially continuous, radially outwardly extending flange, and said sealing surface is on a side of said flange near the radially outer extremity thereof.

4. The turbine seal and lubrication construction of claim 3 further including an O-ring seal between said annular seal and said seal holder 5. The turbine seal and lubrication construction of claim 1 further including an interior shaft within said hollow shaft and in generally spaced relation to the interior thereof, a baffle carried by said interior shaft and sealingly engaging the interior of said hollow shaft on one side of said passages, an additional passage through said hollow shaft and spaced from said passages to open into the hollow shaft on the other side of said baffle, and an annular labyrinth seal on said hollow shaft and extending into proximity of said housing and located between said passages and said additional passage.

6. The turbine seal and lubrication construction of claim 1 wherein said hollow shaft includes an outwardly opening groove, and a resilient, C-clip retained in said groove above the bottom thereof and extending partly out of said groove, one of said seals having a cam surface adapted to engage said C-clip and cam the same fully into said groove so that said one seal may move axially past said C-clip to be retained on said hollow shaft thereby.

7. A turbine seal and lubrication construction comprising:

a housing;

a hollow shaft extending through said housing and adapted to receive lubricant in its interior;

a bearing journalling said shaft for rotation within said housing and including an inner race mounted on said shaft, an outer race mounted within said housing and movable bearing elements located between said races;

a peripheral radially outwardly extending flange on said inner race and terminating in an axially facing sealing surface;

an annular seal holder having an axially opening seal receiving cavity mounted on said housing with said cavity opening toward said sealing surface;

a spring in said cavity;

a ring-like carbon face seal partially in said cavity and urged by said spring against said sealing surface;

at least one radial bore in said shaft;

at least one bore in said inner race between said flange and said bearing elements; and an annular groove at the interface of said inner race and said shaft and establishing fluid communication between said bores.

8. The turbine seal and lubrication construction of claim 7 wherein said annular groove is in said inner race.

9. The turbine seal and lubrication construction of claim 7 wherein said flange, radially inward of said sealing surface includes a section of reduced axial thickness.

* * * * *